US011749145B2

(12) United States Patent
Agahian et al.

(10) Patent No.: US 11,749,145 B2
(45) Date of Patent: Sep. 5, 2023

(54) COLOR CALIBRATION OF DISPLAY MODULES USING A REDUCED NUMBER OF DISPLAY CHARACTERISTIC MEASUREMENTS

(71) Applicant: Google LLC, Mountain View, CA (US)

(72) Inventors: Farnaz Agahian, San Jose, CA (US); Daniel Solomon, San Jose, CA (US)

(73) Assignee: Google LLC, Mountain View, CA (US)

( * ) Notice: Subject to any disclaimer, the term of this patent is extended or adjusted under 35 U.S.C. 154(b) by 499 days.

(21) Appl. No.: 17/044,175

(22) PCT Filed: Dec. 11, 2019

(86) PCT No.: PCT/US2019/065677
§ 371 (c)(1),
(2) Date: Sep. 30, 2020

(87) PCT Pub. No.: WO2021/118556
PCT Pub. Date: Jun. 17, 2021

(65) Prior Publication Data

US 2022/0223076 A1 Jul. 14, 2022

(51) Int. Cl.
*G09G 3/00* (2006.01)
*G09G 3/3208* (2016.01)

(52) U.S. Cl.
CPC ..... *G09G 3/006* (2013.01); *G09G 3/3208* (2013.01); *G09G 2320/0242* (2013.01);
(Continued)

(58) Field of Classification Search
None
See application file for complete search history.

(56) References Cited

U.S. PATENT DOCUMENTS 5,491,568 A 2/1996 Wan
6,954,193 B1 10/2005 Andrade et al.
(Continued)

FOREIGN PATENT DOCUMENTS

CN 109981839 7/2019
CN 111241890 6/2020
(Continued)

OTHER PUBLICATIONS

Wen, et al., "Improving Under-Display Fingerprint Authentication Latency by Normalizing Frame Luminance", Technical Disclosure Commons—https://www.tdcommons.org/dpubs_series/5006, Mar. 24, 2022, 12 pages.
(Continued)

*Primary Examiner* — Fred Tzeng
(74) *Attorney, Agent, or Firm* — Colby Nipper PLLC

(57) ABSTRACT

This document describes techniques and apparatuses for performing color calibration of display modules using a reduced number of display characteristic measurements. In aspects, methods include generating a measured lookup table (50) for a source display module (32), using dynamic optimization to down-sample the measured lookup table and select a set of color patches, sending the color patches to a testing display module; measuring output values for the testing display module; generating a sparse lookup table (52) relating the color patches and the measured output values, up-sampling the sparse lookup table to a forward lookup table (54), and inverting the forward lookup table to generate a reverse lookup table (56). The reverse lookup table (56) can be utilized to determine correct output values (29) for driving a target display module to generate color lights within a display module color gamut.

20 Claims, 4 Drawing Sheets

(52) U.S. Cl.
CPC . *G09G 2320/0693* (2013.01); *G09G 2340/06* (2013.01); *G09G 2360/04* (2013.01)

(56) References Cited

U.S. PATENT DOCUMENTS

| | | | | |
|---|---|---|---|---|
| 6,990,249 | B2 * | 1/2006 | Nomura | H04N 1/00135 348/580 |
| 7,123,223 | B2 | 10/2006 | Moon | |
| 7,126,611 | B1 | 10/2006 | Weed | |
| 7,333,080 | B2 * | 2/2008 | Miller | G09G 3/2003 345/694 |
| 7,697,165 | B2 | 4/2010 | Osaki et al. | |
| 7,728,845 | B2 | 6/2010 | Holub | |
| 7,843,465 | B1 * | 11/2010 | Shaick | H04N 1/6019 345/589 |
| 7,844,109 | B2 | 11/2010 | Matsuura | |
| 7,940,434 | B2 | 5/2011 | Inoue | |
| 7,940,982 | B1 * | 5/2011 | Shaick | H04N 1/6058 382/167 |
| 8,045,796 | B2 | 10/2011 | Matsuoka et al. | |
| 8,098,260 | B1 * | 1/2012 | Shaick | H04N 1/6019 345/589 |
| 8,441,691 | B2 | 5/2013 | Mestha et al. | |
| 8,638,340 | B2 | 1/2014 | Holub | |
| 8,870,393 | B2 | 10/2014 | Kawahara | |
| 9,697,758 | B2 | 7/2017 | Watanabe et al. | |
| 9,754,522 | B2 | 9/2017 | Park et al. | |
| 9,858,640 | B1 | 1/2018 | Earl et al. | |
| 9,933,887 | B2 | 4/2018 | Choi | |
| 10,068,551 | B1 | 9/2018 | Choi et al. | |
| 10,424,269 | B2 | 9/2019 | Chen et al. | |
| 10,453,423 | B2 | 10/2019 | Nasiriavanaki et al. | |
| 10,510,317 | B2 | 12/2019 | Spence et al. | |
| 10,986,345 | B2 * | 4/2021 | Guo | H04N 19/33 |
| 11,163,970 | B1 | 11/2021 | Sammoura et al. | |
| 11,403,984 | B2 | 8/2022 | Jung et al. | |
| 2002/0039104 | A1 * | 4/2002 | Sato | H04N 1/60 345/600 |
| 2002/0050958 | A1 | 5/2002 | Matthies et al. | |
| 2002/0067326 | A1 | 6/2002 | Aoki | |
| 2003/0189613 | A1 * | 10/2003 | Mahy | H04N 1/6019 347/19 |
| 2005/0062992 | A1 * | 3/2005 | Kishimoto | H04N 1/603 358/1.9 |
| 2006/0204083 | A1 | 9/2006 | Takahashi | |
| 2008/0055210 | A1 | 3/2008 | Cok | |
| 2008/0266314 | A1 * | 10/2008 | Butterworth | G09G 5/02 345/590 |
| 2009/0080041 | A1 * | 3/2009 | Fan | H04N 1/6019 358/518 |
| 2009/0185058 | A1 * | 7/2009 | Vakrat | H04N 25/60 348/241 |
| 2010/0060667 | A1 | 3/2010 | Chen et al. | |
| 2010/0207860 | A1 | 8/2010 | Chang et al. | |
| 2012/0013635 | A1 | 1/2012 | Beeman et al. | |
| 2012/0147291 | A1 | 6/2012 | Seo | |
| 2013/0136344 | A1 * | 5/2013 | Obrecht | H04N 1/40012 382/162 |
| 2013/0256672 | A1 | 10/2013 | Kimura | |
| 2013/0314447 | A1 | 11/2013 | Wu et al. | |
| 2013/0342519 | A1 | 12/2013 | Kim et al. | |
| 2014/0292628 | A1 | 10/2014 | Park | |
| 2015/0287352 | A1 | 10/2015 | Watanabe et al. | |
| 2016/0063933 | A1 | 3/2016 | Kobayashi et al. | |
| 2016/0078838 | A1 | 3/2016 | Huang et al. | |
| 2016/0078846 | A1 | 3/2016 | Liu et al. | |
| 2016/0210907 | A1 | 7/2016 | Hsieh et al. | |
| 2016/0210923 | A1 | 7/2016 | Yoshida et al. | |
| 2017/0004760 | A1 | 1/2017 | Jang et al. | |
| 2017/0062547 | A1 | 3/2017 | Mathew et al. | |
| 2017/0092196 | A1 | 3/2017 | Gupta et al. | |
| 2017/0098429 | A1 | 4/2017 | Sullivan et al. | |
| 2017/0140556 | A1 | 5/2017 | Safaee-Rad et al. | |
| 2018/0151109 | A1 | 5/2018 | Shim et al. | |
| 2018/0254020 | A1 * | 9/2018 | Buckley | G09G 5/06 |
| 2018/0277051 | A1 | 9/2018 | Du | |
| 2018/0301080 | A1 | 10/2018 | Shigeta et al. | |
| 2019/0027082 | A1 | 1/2019 | Belle | |
| 2019/0052904 | A1 | 2/2019 | He et al. | |
| 2019/0079930 | A1 * | 3/2019 | Wyman | G06F 3/1415 |
| 2019/0132001 | A1 | 5/2019 | Deng et al. | |
| 2019/0147832 | A1 | 5/2019 | Kim et al. | |
| 2019/0180691 | A1 | 6/2019 | Takasugi | |
| 2019/0228740 | A1 | 7/2019 | Aflatooni et al. | |
| 2020/0051225 | A1 | 2/2020 | Barron et al. | |
| 2020/0066236 | A1 | 2/2020 | Giusti et al. | |
| 2020/0258442 | A1 * | 8/2020 | Mandle | H04N 9/3105 |
| 2020/0273427 | A1 | 8/2020 | Wang | |
| 2020/0273919 | A1 | 8/2020 | Ding et al. | |
| 2020/0312231 | A1 | 10/2020 | Hussell | |
| 2020/0402478 | A1 | 12/2020 | Her et al. | |
| 2021/0074239 | A1 * | 3/2021 | Tao | G06T 1/20 |
| 2021/0097958 | A1 * | 4/2021 | Fores Herranz | G09G 3/3233 |
| 2021/0183333 | A1 | 6/2021 | Holland et al. | |
| 2021/0201731 | A1 | 7/2021 | Ranjan et al. | |
| 2021/0408140 | A1 | 12/2021 | Han et al. | |
| 2022/0044629 | A1 | 2/2022 | Wen et al. | |
| 2022/0059008 | A1 * | 2/2022 | Bogdanowicz | G02B 5/201 |
| 2022/0130308 | A1 | 4/2022 | Jung et al. | |

FOREIGN PATENT DOCUMENTS

| | | |
|---|---|---|
| CN | 111477135 | 7/2020 |
| CN | 112331145 | 2/2021 |
| CN | 113053306 | 6/2021 |
| JP | 2013106347 | 5/2013 |
| KR | 20060124209 | 12/2006 |
| KR | 20120120098 | 11/2012 |
| KR | 20160080768 | 7/2016 |
| KR | 102279278 | 7/2021 |
| WO | 2000045605 | 8/2000 |
| WO | 20090152526 | 12/2009 |
| WO | 2022105484 | 5/2022 |

OTHER PUBLICATIONS

"CIE 1931 color space—Wikipedia", Retrieved at: https://en.wikipedia.org/wiki/CIE_1931_color_space—on Feb. 7, 2023, 16 pages.

"White point—Wikipedia", Retrieved at: https://en.wikipedia.org/wiki/White_point—on Feb. 7, 2023, 2 pages.

Agahian, et al., "Clustering-Based Display Calibration", Technical Disclosure Commons, https://www.tdcommons.org/dpubs_series/5611, Jan. 2, 2023, 7 pages.

Hohmann, et al., "Performance Optimization for In-Vehicle Desplays", Jul. 2018, 5 pages.

Yang, "Determining an Optimal Display Module-Level White Point Target for a Display Module", Technical Disclosure Commons—https://www.tdcommons.org/dpubs_series/5718 Mar. 7, 2023, 12 pages.

"International Preliminary Report on Patentability", Application No. PCT/US2019/065677, dated May 17, 2022, 18 pages.

"International Search Report and Written Opinion", PCT Application No. PCT/US2019/065677, dated May 26, 2020, 25 pages.

Colantoni, et al., "High-End Colorimetric Display Characterization Using an Adaptive Training Set", Society for Information Display, 2011, 11 pages.

Dianat, et al., "Dynamic Optimization Algorithm for Generating Inverse Printer Map with Reduced Measurements", Published in the proceedings of IEEE Int. Conference on Acoustics, Speech, and Signal Processing, May 14-19, 2006, Toulouse, France., May 2006, 5 pages.

Eiriksson, et al., "Predicting Color Output of Additive Manufactured Parts", Proceedings of Achieving Precision Tolerances in Additive Manufacturing: ASPE Spring Topical Meeting, Jan. 1, 2015, Jan. 1, 2015, 6 pages.

Mestha, et al., "Control of Color Imaging Systems: Analysis and Design", Chapter 6.5; Compression of Lookup Tables, 2009, 14 pages.

(56) References Cited

OTHER PUBLICATIONS

Poynton, et al., "Innovations in 3D Colour LUT's for Display Calibration", https://kb.portrait.com/help/innovations-in-3d-colour-lut-s-for-display-calibration accessed Aug. 29, 2019, Apr. 2, 2019, 13 pages.
Choi, et al., "Disabling Transitions When Encoded Intensity is Low", Application No. PCT/US2021/070522, filed May 10, 2021, 46 pages.
Karri, et al., "User Interface Mitigation of Display Artifacts During Transitions between Display Clock Speeds", Technical Disclosure Commons, https://www.tdcommons.org/dpubs_series/5427, Nov. 4, 2022, 7 pages.
Kim, et al., "Adaptive Display Frequency Control for Power Savings", Technical Disclosure Commons, https://www.tdcommons.org/dpubs_series/5476, Nov. 4, 2022, 12 pages.
Poynton, et al., "Innovations in 3-D Colour LUTs for Display Calibration", https://kb.portrait.com/help/innovations-in-3d-colour-lut-s-for-display-calibration, Jan. 2014, 9 pages.
Choi, et al., "Dynamically Altering Clock Signal Frequencies in LTPO AMOLED Displays", Technical Disclosure Commons, https://www.tdcommons.org/dpubs_series/4652, Oct. 12, 2021, 11 pages.
Choi, et al., "Expediting Fingerprint Authentication by Compensating for Display Luminance Latency", Technical Disclosure Commons, https://www.tdcommons.org/dpubs_series/4686, Oct. 29, 2021, 11 pages.
Shin, et al., "Dynamic Voltage Scaling of OLED Displays", Jun. 2011, 6 pages.
Yonebayashi, et al., "High refresh rate and low power consumption AMOLED panel using top-gate n-oxide and p-LTPS TFTs", Mar. 2020, 10 pages.
Youn, et al., "Image Data Compensation to Prevent Display Artifacts on an OLED Display", Technical Disclosure Commons, https://www.tdcommons.org/dpubs_series/4615, Sep. 23, 2021, 8 pages.
Choi, et al., "Readability Enhancements for Device Displays used in BrightReadability Enhancements for Device Displays used in BrightLighting Conditions", Technical Disclosure Commons—https://www.tdcommons.org/dpubs_series/3871, Dec. 10, 2020, 9 pages.
Antonio-Torres, et al., "LUT-based compensation model for OLED degradation", May 2005, pp. 435-441.
Kim, et al., "Pixel Burn-In Compensation Parameter Compression for Organic Light Emitting Diode Displays", Technical Disclosure Commons, https://www.tdcommons.org/dpubs_series/5871, May 8, 2023, 12 pages.

* cited by examiner

COLOR CALIBRATION OF DISPLAY MODULES USING A REDUCED NUMBER OF DISPLAY CHARACTERISTIC MEASUREMENTS

BACKGROUND

A display device is a portable device that has both computational and communication capabilities (e.g., mobile device, portable telecommunication device, wireless-communication device, mobile phone, cellular phone, smartphone, computing device, tablet computer, laptop computer, wearable device, and the like). A display device typically includes one or more output devices, each a "display module," that display information in pictorial form. Examples of display modules include organic light-emitting diode (OLED) displays, liquid crystal displays (LCD), plasma displays, and cathode ray tube (CRT) displays. Display devices are configured to receive input signals for driving a display module to generate color lights within a display module color gamut. For example, a display device may be configured to receive input signals representing RGB (red, green, blue) values for driving the display module of the display device to generate color lights in an RGB color space.

A color space is a specific organization of colors. Examples of color spaces include the CIE XYZ color space and the RGB color space. The XYZ color space (also referred to as the "CIE 1931 color space") is a fundamental and device-independent color space. The XYZ color space has imaginary primaries that are defined in terms of tristimulus values referred to as X, Y, and Z.

The RGB color space is a subset of the XYZ color space, whose primaries are real and can be generated. An example of an RGB color space is sRGB (standard RGB). RGB color space values are device-dependent, meaning that identical RGB triplets (in an RGB input signal) can result in the display of different colors depending on the display device and the display module. For example, a first mobile device and a second mobile device, of the same make and model, are manufactured on the same day. While the first mobile device and the second mobile device may have display modules with identical part numbers, the two display modules may perform differently due to manufacturing tolerances and other reasons. As a result, the same RGB input values may result in the display module of the first mobile device displaying the color red correctly, whereas the display module for the second mobile device may display the color red in a different shade. To address such variations, the display module of the second mobile device may be calibrated through the use of a color correction profile to correct the display output to match the desired color standard. For example, a color correction profile could be used on the second mobile device to cause the correct shade of red to be displayed by its display module.

As display devices are manufactured, the color output on each display module is typically color-calibrated in the factory during the assembly of the display device. Color calibration is necessary because display modules may be sourced from various display module vendors, and each specific display module may have different output characteristics for a given input. Without color calibration, display modules from the same brand and batch may display the same image differently when compared to one another. As a result, color calibration is crucial for the accurate color rendering of objects on display modules.

By performing a per display module calibration, the display modules can be aligned to a specific display calibration. For example, a calibration profile (e.g., a lookup table), which approximates the mapping between RGB color space values and XYZ color space values (an RGB-to-XYZ lookup table (LUT)), can be calculated on the display device. The calibration profile can then be used by the display device to correct for differences in a color range between the RGB input values and the RGB color space of the display module, such that the gamut of the display module displays the desired color, typically based on a standard. To render specific colors accurately on a display module, the transformation from XYZ to RGB is of great importance. This transformation can be a simple 3×3 matrix based on the measured XYZ values for white as well as pure red, green, and blue colors emitted by the display module at the peak luminance. However, this type of modeling (e.g., 3×3 matrix) is based on certain assumptions (e.g., additivity) and is therefore restricted to well-behaved display modules.

Certain types of display modules (e.g., OLED panels), violate these assumptions due to non-linear channel-to-channel cross-talk that causes the output of a color channel to affect the output of another color channel. This color channel interaction can violate an additivity assumption and, as a result, OLED display module modeling using 3×3 matrix transformation (3×3 matrixing) introduces inaccuracies in calibration. As a result, throughout the display module's color gamut, there are areas in which the measured XYZ values are not linear with respect to RGB input values.

As a result, some types of display modules require more calibration than others. For example, the calibration of a liquid crystal display (LCD) display module can be performed by making a limited number of display characteristic measurements and performing a mathematical process to create a simple calibration profile (RGB-to-XYZ LUT) that is stored in memory on at least one of the display device or the display module.

In contrast, the calibration of an organic light-emitting diode (OLED) display module is considerably more complicated. This complication is due to trade-offs (e.g., electrical design) that display module vendors make and variations in light-emitting diode levels of color saturation. For an OLED, to generate a consistent (from display module to display module) color response from the same uncalibrated display RGB input values, an increased number of display characteristic measurements need to be taken during the factory calibration of the display module to create the calibration profile (RGB-to-XYZ LUT).

A calibration process for an OLED display module may include establishing a first relationship (RGB-to-XYZ LUT) between the input RGB and desired XYZ by computing the desired XYZ values from the RGB input values using the standard matrices, establishing a second relationship (RGB-to-XYZ LUT) between the RGB input values and the measured resulting color (XYZ) responses; establishing a third relationship (e.g., XYZ-to-RGB LUT) by inverting the second relationship (RGB-to-XYZ LUT); and concatenation of the first relationship (RGB-to-XYZ LUT) and the third relationship (XYZ-to-RGB LUT) to create an RGB-to-RGB relationship (e.g., third LUT, such as an RGB-to-RGB LUT) that dictates the adjustments done to RGB output values sent to the target display module so that the display module generates the desired (calibrated) color.

In such an OLED display module calibration process, a brute force approach may be utilized to generate the second relationship (RGB-to-XYZ LUT). The second relationship (RGB-to-XYZ LUT) typically contains a large number of color values in the input color space (RGB) and corresponding color values in the output color space (XYZ). In creating the second relationship (RGB-to-XYZ LUT), a tradeoff may need to be made between (1) the time required for measuring a potentially large number of color patches used for the creation of the lookup table, and (2) the accuracy of the results of the calibration process. The time spent measuring the color patches can directly impact manufacturing time and cost.

SUMMARY

Techniques and apparatuses are described for performing color calibration of display modules using a reduced number of display characteristic measurements.

Aspects described below include a method of performing color calibration of organic light-emitting diode display modules using a reduced number of display characteristic measurements. In the method, original RGB input values are sent to a source organic light-emitting diode (OLED) display module having a first color gamut and XYZ output values across the first color gamut of the source display module are measured. A measured three-dimensional lookup table (measured 3D LUT) relating the original RGB input values to corresponding measured XYZ output values is generated. Dynamic optimization is used to select a set of M number of RGB input values from the original RGB input values. The set of M RGB input values are then sent to an OLED testing display module having a second color gamut and XYZ output values across the second color gamut for the M RGB color patches are measured. A sparse 3D LUT relating the M RGB input values to corresponding measured XYZ output values is generated. The sparse 3D LUT is up-sampled to generate a forward 3D LUT relating RGB input values to corresponding XYZ output values. Finally, the forward 3D LUT is transformed to generate a reverse 3D LUT by performing an inversion process on the forward 3D LUT.

Up-sampling the sparse three-dimensional lookup table to generate a forward three-dimensional lookup table relating RGB input values to corresponding XYZ output values may include generating intermediate XYZ output values utilizing the measured XYZ output values in the sparse three-dimensional lookup table. Generating intermediate XYZ output values utilizing the measured XYZ output values in the sparse three-dimensional lookup table may include utilizing a triangulation-based interpolation method to estimate the intermediate XYZ output values.

The triangulation-based interpolation method utilized to estimate the intermediate XYZ output values may be a tetrahedral interpolation process that includes: forming a plurality of Delaunay tetrahedron by tetrahedralization of irregular input lattice points in the sparse three-dimensional lookup table utilizing a three-dimensional Delaunay tetrahedralization technique; selecting an RGB input color; locating Delaunay tetrahedrons to which the RGB input color belongs; and performing tetrahedral interpolation on the located Delaunay tetrahedrons to estimate an intermediate XYZ output value corresponding to the selected RGB input color.

The RGB input color may be an RGB triplet and performing tetrahedral interpolation on the located Delaunay tetrahedrons to estimate an intermediate XYZ output value corresponding to the selected RGB input color may include performing barycentric interpolation of XYZ values of vertices of a Delaunay tetrahedron surrounding the RGB triplet.

Performing tetrahedral interpolation on the located Delaunay tetrahedrons to estimate an intermediate XYZ output value corresponding to the selected RGB input color may include performing linear interpolation in the form of distance-weighted average among neighboring vertices on the located Delaunay tetrahedrons.

The triangulation-based interpolation method utilized to estimate the intermediate XYZ output values may be a triangular interpolation process including forming a plurality of Delaunay triangles by triangulation of irregular input lattice points in the sparse three-dimensional lookup table utilizing a three-dimensional Delaunay triangulation technique; selecting an RGB input color; locating Delaunay triangles to which the RGB input color belongs; and performing triangular interpolation on the located Delaunay triangles to estimate an intermediate XYZ output value corresponding to the selected RGB input color.

The target display module may be driven by a target display device, and the method may include utilizing the reverse three-dimensional lookup table to create a calibration profile for the target display module and storing the calibration profile on at least one of the target display device or the target display module. The calibration profile may be stored on at least one of the target display device or the target display module.

The method may include measuring XYZ output values across the first color gamut is performed by a sensor. The method may include measuring XYZ output values across the second color gamut is performed by a sensor. In aspects, the first color gamut and second color gamut are the same color gamut.

Using dynamic optimization to select a set of M number of RGB input values from the original RGB input values may include applying a dynamic optimization algorithm. The dynamic optimization algorithm may select the set of M number of RGB input values to minimize the total error between the measured output values (e.g., CIELAB values, measured CIELAB output values) and the estimated output values (e.g., CIELAB values, estimated CIELAB output values) for the original RGB input values.

The method may include utilizing the reverse three-dimensional lookup table to determine corrected RGB output values for driving at least one of the organic light-emitting diode testing display module or an organic light-emitting diode target display module.

Aspects described below include methods of performing color calibration of display modules using a reduced number of display characteristic measurements. Aspects described below also include one or more computer-readable storage media storing executable instructions that, responsive to execution by a processor, implement procedures for performing color calibration of display modules using a reduced number of display characteristic measurements. Aspects described below also include a system comprising means for performing procedures for performing color calibration of display modules using a reduced number of display characteristic measurements. Optional features of one aspect, such as the method described above, may be combined with other aspects.

BRIEF DESCRIPTION OF THE DRAWINGS

Techniques and apparatuses for performing color calibration of display modules using a reduced number of display characteristic measurements are described with reference to the following drawings. The same numbers are used throughout the drawings to reference like features and components.

DETAILED DESCRIPTION

Overview

Figure 1:
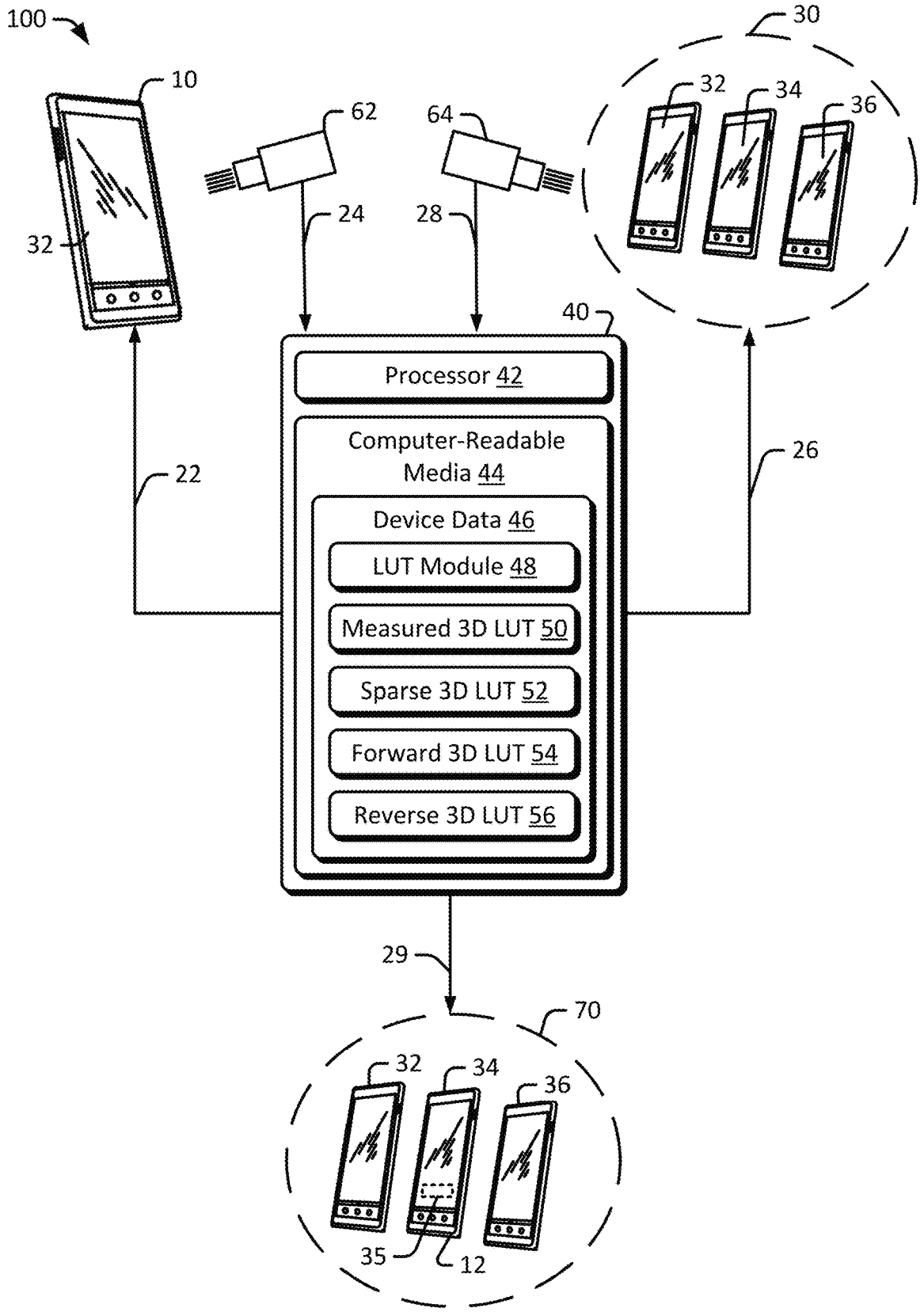
FIG. 1 illustrates an environment in which techniques and apparatuses for performing color calibration of display modules using a reduced number of display characteristic measurements can be implemented.

This document describes techniques and apparatuses directed to the color calibration of display modules using a reduced number of display characteristic measurements, thereby improving color-calibration processes by saving time and cost, while preserving a high-quality calibration accuracy. Also described are methods of deriving a color calibration, methods of calibrating a display module, and methods of generating three-dimensional lookup tables. That is, aspects of the present disclosure address technical problems associated with the calibration of display modules, and in particular to the color calibration of display modules.

While features and concepts of the described techniques and apparatuses for performing color calibration of display modules using a reduced number of display characteristic measurements can be implemented in any number of different environments, systems, devices, and/or various configurations, aspects of performing color calibration of display modules using a reduced number of display characteristic measurements are described in the context of the following example devices, systems, and configurations.

While throughout the detailed description examples useful for understanding the described techniques and apparatuses for performing color calibration of display modules using a reduced number of display characteristic measurements are described with respect to organic light-emitting diode (OLED) display modules, it is understood that the display modules referred to may be other types of display modules, including, but not limited to, liquid crystal displays (LCD), plasma displays, and cathode ray tube (CRT) displays.

As used herein, the phrase "lookup table" or "LUT," refers to any mapping readable by a computer. As used herein, the term "forward" refers to lookup table mapping from a first color space to a second color space, and the term "reverse" refers to lookup table mapping from the second color space to the first color space. In aspects, an RGB-to-XYZ LUT is a forward LUT, and an XYZ-to-RGB LUT is a reverse LUT.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

Characterization is the process of establishing the mapping of an input signal (e.g., RGB input values), defined in content color space (typically an RGB triplet), to another set of digital values (e.g., XYZ values), defined within display module color gamut, that create the desired color (color light) with a sufficient accuracy on the display module.

As used herein, XYZ refers to a device-independent color space with the tristimulus values XYZ that is determined by the color-matching functions of the XYZ color system stipulated by the Commission International de L'Eclairage, an international color standards body, and spectral power distribution of the light. In an example, a display device receives RGB input values for driving the display module, which in turn generates color lights in an RGB color space that can be quantified in terms of XYZ. As described above, the goal for color calibrating a display module is to correct for differences in the color range between the native color gamut of the display and the desired display output, such that the target display module displays the correct color (e.g., based on a standard).

Display Module Characterization Processes

FIG. 1 illustrates an environment in which techniques and apparatuses for performing color calibration of display modules using a reduced number of display characteristic measurements can be implemented, for example a display module characterization process 100. The display module characterization process 100 may be performed by a computing device 40 that includes at least one processor 42 and a computer-readable medium (CRM) 44. The CRM 44 may include any suitable memory or storage device such as random-access memory (RANI), static RAM (SRAM), dynamic RAM (DRAM), non-volatile RAM (NVRAM), read-only memory (ROM), or flash memory. CRM 44 includes device data 46. The device data 46 includes user data, multimedia data, applications, and/or an operating system of the computing device 40, which are executable by the processor(s) to enable techniques and apparatuses for performing color calibration of display modules using a reduced number of display characteristic measurements. The device data 46 may include executable instructions of a lookup table module 48 that can be executed by the processor(s). The lookup table module 48 represents functionality that causes the computing device 40 to perform operations described within this document. The device data 46 may include one or more three-dimensional lookup tables (e.g., a measured 3D LUT 50, a sparse 3D LUT 52, a forward 3D LUT 54, and a reverse 3D LUT 56).

In the illustrated display module characterization process 100, display input values 22 (e.g., original input values 22, original RGB input values 22, RGB input values 22) are sent to a source display module 32 (e.g., an OLED display module) of a source display device 10. In aspects, the original RGB input values 22 represent all possible combinations of R, G, and B values in a N×N×N (e.g., 17×17×17) cube. The source display module 32 has a first color gamut. The resulting display output of the display module 32 is measured, for example by at least one sensor 62, to generate display output values 24 (e.g., XYZ output values) across the first color gamut in response to the display input values 22. The display output values 24 may be stored as device data 46 on the computing device 40.

A mapping (e.g., measured three-dimensional (3D) lookup table (LUT) 50) relating the display input values 22 to corresponding measured display output values 24 is then generated. The display input values 22 may represent a first color space (e.g., RGB color space values) and the display output values 24 may represent a second color space (e.g., XYZ color space values). The display input values 22 may be RGB input values uniformly spaced along R, G, and B domains and the display output values 24 may be measured in XYZ output values. The entries in the measured 3D LUT 50 include a set of color patches (e.g., K number of color patches). The measured display output values 24 may be stored as device data 46 on the computing device 40.

Dynamic optimization (e.g., a dynamic optimization algorithm) is used to optimally sample (down-sample) the entries (K color patches) in the measured 3D LUT 50 and select a set of M number of color patches (M color patches) from the set of K color patches from the measured 3D LUT 50, where M<<K. The M color patches represent input values 26 (M input values 26, M RGB input values 26). Once the M color patches are selected by dynamic optimization, the input values 26 are sent to at least one testing display module 30 (e.g., source display module 32, target display module 34, display module 36) that is to be color calibrated to measure the testing display module 30. In aspects, the source display module 32 is a testing display module 30. The input values 26 can be used to generate color lights within at least one color gamut of the testing display module 30. The color lights are measured, for example by at least one sensor 64, to generate testing display measurement results (e.g., output values 28). The output values 28 may be measured in output values (e.g., M XYZ output values) that correspond to the input values 26 (e.g., M RGB input values). The output values 28 may be stored as device data 46 on the computing device 40.

A mapping (sparse 3D LUT 52) relating the input values 26 (e.g., RGB input values) to corresponding measured output values 28 (e.g., XYZ output values) is generated. The sparse 3D LUT 52 may be stored as device data 46 on the computing device 40. The sparse 3D LUT 52 is a lattice of scattered color points. By using dynamic optimization for color patch selection, the generated sparse 3D LUT 52 has more data points in areas in which the display shows more non-linearity and less data points in areas in which measured colors are more linear with respect to the input signal.

The remaining color patches (K-M) are estimated using tetrahedral interpolation given the information of the M measured color patches. In aspects, this estimation is performed by up-sampling the entries in the sparse 3D LUT 52 to generate a forward 3D LUT 54. For example, the output values 28 and input values 26 in the sparse 3D LUT 52 may be up-sampled through a triangulation-based interpolation method to estimate intermediate output values in addition to the output values 28 in the sparse 3D LUT 52. This estimation process is not always perfect and there may be some error. The goal of dynamic optimization (e.g., the dynamic optimization algorithm) is choosing those M color patches (input values) that minimize the total error (e.g., the error between the color of the original measured color patches and the interpolated (estimated) color patches). In aspects, a dynamic optimization algorithm is applied to select a set of M number of RGB input values from the original RGB input values to minimize the total error between the measured output values (e.g., CIELAB values, measured CIELAB output values) and the estimated output values (e.g., CIELAB values, estimated CIELAB output values) for the K RGB input values. The conversion of XYZ to L*a*b* CIELAB values is a mathematical conversion.

The forward 3D LUT 54 may be stored as device data 46 on the computing device 40. The forward 3D LUT 54 can also be described as an up-sampled sparse 3D LUT 52. The forward 3D LUT 54 may be the same size as the measured 3D LUT 50 (e.g., both the forward 3D LUT 54 and the measured 3D LUT 50 are N×N×N LUT).

The forward 3D LUT 54 is then inverted to create a per-unit reverse 3D LUT 56 that can be used for profiling a target display module 70 (e.g., source display module 32, target display module 34, display module 36). A matrix inversion operation (e.g., matrix inverse) may be used to invert the forward 3D LUT 54. The forward 3D LUT 54 is used to determine corrected output values 29 (e.g., RGB output values) for driving the target display module 70 to generate color lights within a target display module color gamut. A computing device 40, for example a lookup table (LUT) module 48 stored as device data 46 on the CRM 44, may generate the corrected output values 29. The corrected output values 29 may be stored in memory on at least one of the target display device or the target display module 70, for example, in memory 35 on at least one of the target display device 12 or the target display module 34.

The target and source display modules can be the same display module. The target and source display devices can be the same display device. In aspects, the source display module and the target display module are organic light-emitting diode display modules. While in FIG. 1, target display module 70 is illustrated as a testing display module 30, in aspects, target display module 70 may not be a testing display module 30. While in FIG. 1, the source display module 32 is illustrated as a separate display module from the testing display module 30, in aspects, the source display module 32 is a testing display module 30. Likewise, while FIG. 1, the testing display module 30 is illustrated as a separate display module from the target display module 70, in aspects, the testing display module 30 is a target display module 70.

The disclosed techniques and apparatuses relate to performing color calibration of display modules. In aspects, the color calibration is performed utilizing a reduced number of display characteristic measurements.

Figure 2:
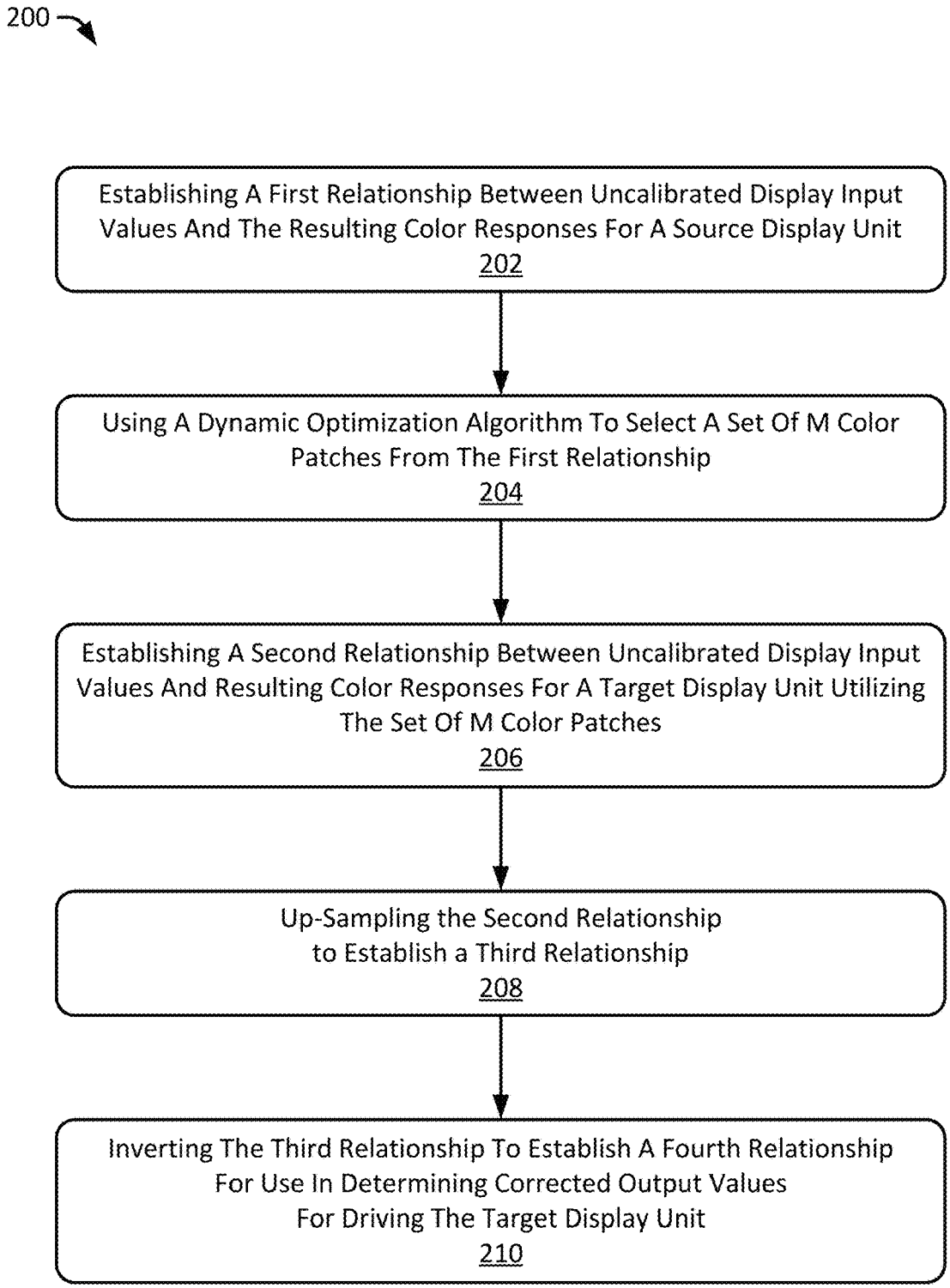
FIG. 2 illustrates a process of performing color calibration of display modules using a reduced number of display characteristic measurements.

Referring to FIG. 2, illustrated is a display module characterization process 200 for performing color calibration of display modules. In aspects, such as described below, the process 200 may include one or more of the components illustrated with respect to the display module characterization process 100 of FIG. 1. In process 200, a display module 32 is selected for characterization. The display module 32 may be representative of typical display modules and can be referred to as a "source" or "golden" display module.

In a first operation 202, the source display module 32 is tested to establish a first relationship (e.g., a measured 3D LUT 50) between uncalibrated display input values (an input color space) and the resulting color responses for the source display module (a display color space). The source display module 32 may be tested in a laboratory or testing environment. Input values 22 may be provided as input (sent) to the source display module 32 to generate color lights within a display module color gamut. In aspects, the input values 22 may be RGB signals representing red, green, and blue values for driving the source display module 32 to generate color lights in an RGB color space. In aspects, the input values 22 are uncalibrated display input values.

The resulting color responses (display characteristics) are measured across the color gamut of the display module 32 to generate output values 24. The output values 24 may be responsive to the input values 22. In aspects, the color responses are measured by at least one sensor 62, such as an optical instrument (e.g., spectrometer, spectroradiometer).

In an example, display input values 22 of R:255, G:165, B:0, representing the color orange, can be provided as an input to the source display module 32 to generate color lights within a display module color gamut. Sensor(s) 62 are used to measure the output XYZ of the source display module 32 to generate output values 24. The color responses (output values 24) may have XYZ output values of 54.697, 48.174, 6.418. In aspects, the color responses are measured by the sensor(s) 62 and are provided as an input to the computing device 40.

In aspects, a lookup table module 48 (LUT module 48) implemented on the CRM 44 of the computing device 40 generates the first relationship (measured 3D LUT 50) relating the display input values 22 to output values 24 indicative of the resulting (measured) color responses. The measured 3D LUT 50 may be stored on the CRM 44 of the computing device 40, for instance, as device data 46.

The measured 3D LUT 50 includes a series of nodes in an input color space (the display input values 22) and stored at each node are the resulting color responses (the output values 24). In an example, the input values 22 represent RGB input values, and the output values 24 represent XYZ output values. In such an example, the measured 3D LUT 50 is a lookup table between input RGB nodes and output XYZ nodes (an RGB-to-XYZ 3D LUT). While RGB and XYZ color spaces are used in this example, in aspects, the values of other colorimetric systems (e.g., values of YCC, values of CMY, values of a CIE L*a*b* (CIELAB) colorimetric system, values of a CIELUV colorimetric system) may be used for at least one of the input values or the output values in any of the examples described herein.

The measured 3D LUT 50 includes a set of K number of color patches. In aspects, the term "color patch" refers to a color, such as a combination of R, G, and B values, generated by a display module color primaries. Within the RGB color space, a plurality of combinations of R, G, and B values are possible. For example, within one type of RGB color space, there are 16,777,216 ($256^3$) discrete combinations of R, G, and B values possible, frequently referred to as "16 million" colors. As a result, to measure all possible color patches within such a display module color gamut, more than 16 million measurements of color patches would need to be taken.

The number of display characteristic measurements that are taken to generate the measured 3D LUT 50 can be any suitable number up to the total number of colors (e.g., up to 16,777,216). In aspects, the number of display characteristic measurements is selected by dividing the R, G, and B values into "N" lattice points on the R, G, and B axes, respectively, to form a table of N×N×N. For example, dividing the R, G, and B values into seventeen (17) lattice points would translate into 4913 (17×17×17) display characteristic measurements measured uniformly over the display color space. By taking 4913 display characteristic measurements, the full RGB-to-XYZ relationship can be mapped, and the RGB side of a target display module 70 can be tuned, as necessary. In other aspects, the number of display characteristic measurements could be based on other numbers of lattice points, for example, 9×9×9, 32×32×32, and the like. The selected number of display characteristic measurements represent a uniform sample of the total number of colors.

In some aspects, a source display module 32 may be characterized by selecting a number of display characteristic measurements to take, providing display input values 22 to the source display module 32, and measuring (uniformly sampling) display module performance along the R, G, and B axes for the sampled colors to generate output values 24 responsive to the input values 22. For example, the source display module 32 may be characterized by selecting 4913 display characteristic measurements (based on seventeen (17) lattice points on the R, G, and B axes), providing display input values 22 to the source display module 32, and taking the 4913 measurements of the output of the source display module 32 using the sensor 62.

The input values 22 and measured output values 24 establish the first relationship (measured 3D LUT 50) between the display input values 22 (e.g., RGB values) and the resulting color responses (the measured output values 24, e.g., XYZ values) for the source display module 32. The resulting measured 3D LUT 50 has three-dimensions that can be used to convert image data from a first color space (e.g., RGB) to a second color space (e.g., XYZ).

In the second operation 204 illustrated in the process 200 of FIG. 2, dynamic optimization (e.g., a dynamic optimization algorithm) is used to down-sample the measured 3D LUT 50 entries and select a set of M number of color patches (M color patches) from the measured 3D LUT 50 for measurement out of K (all possible N×N×N) color patches. The dynamic optimization algorithm could be used to reduce the number of measurements on each target (uncalibrated) display module 70 to "M" color patches (e.g., M<<K), allowing capture of the RGB-to-XYZ relationship with minimal decrease to accuracy compared to the same measurement done over all K color patches. In aspects, as a result of utilizing the dynamic optimization algorithm, the number of color patches to be measured can be reduced from sixteen million color patches to a much lower number of color patches from which all sixteen million colors on the display module can be modeled.

The dynamic optimization algorithm is a general-purpose algorithm that takes a complex function and reduces the complexity by omitting certain points that are redundant to maintaining some level of low error in estimating the function. The dynamic optimization algorithm is based on dynamic programming, which uses a multistage decision process and definable performance criteria, such as minimization of $\Delta E_{00}$ (DE2000) error or any other color difference metric. $\Delta E_{00}$ represents the color difference (color difference error) between the entries of the measured 3D LUT 50 and an up-sampled forward 3D LUT 54, calculated using the DE2000 color difference formula.

The M color patches (e.g., RGB input values) represent a finite number of colors or points in the color space (e.g., XYZ color space). The dynamic optimization algorithm may select the M color patches by minimizing the difference error between the colorimetric values (CIE L*a*b*) calculated from XYZ output of an N×N×N measured 3D LUT 50 and colorimetric values (CIE L*a*b*) calculated from XYZ output of an N×N×N up-sampled forward 3D LUT 54. The dynamic optimization algorithm may select the M color patches by minimizing the color error between the measured 3D LUT 50 and the forward 3D LUT 54, for example by minimizing the error between the measured color responses 24 (e.g., Lab(out1)), and color responses stored in LUT 54, which are estimated from measured color responses 28 (e.g., Lab(out2)). CIELAB values are calculated from CIEXYZ values.

The error is defined by the equations:

$$\Delta E=\|L^*a^*b^*(\text{out1})-L^*a^*b^*(\text{out2})\| \quad (1)$$

$$L^*a^*b^*(\text{out1})=P(\text{RGB}) \quad (2)$$

$$L^*a^*b^*(\text{out2})=\hat{P}(\text{RGB}) \quad (3)$$

where LUT P is the measured 3D LUT 50 and LUT $\hat{P}$ is the up-sampled forward 3D LUT 54 obtained by up-sampling the sparse 3D LUT 52 containing the finite number (M) of color patches. In aspects, the LUT $\hat{P}$ is the same size as LUT P (e.g., both the LUT $\hat{P}$ and LUT P are N×N×N LUT). In aspects, for Equations 2 and 3, RGB can be every node in the forward 3D LUT 54 or can be a node in a selected high curvature region or axis of the forward 3D LUT 54.

The dynamic optimization algorithm can be used for one-dimensional, two-dimensional, and/or three-dimensional lookup table compression. The two-dimensional and three-dimensional dynamic optimization algorithms are simply extensions of the one-dimensional dynamic optimization algorithm. The three-dimensional approach can be used for optimally selecting the grid points over the entire three-dimensional space (vertices, boundaries, and inside the lookup table) to minimize the color difference between measured and interpolated XYZ tristimulus values for RGB input values. Each of 1-D, 2-D, and 3-D dynamic optimization techniques are described in chapter 6.5 of "Control of Color Imaging Systems: Analysis and Design" by L. K. Mestha and S. A. Dianat. The dynamic optimization algorithm is also described in the paper: Sohail Dianat, L. K. Mestha, and Athimoottil Mathew, "Dynamic Optimization Algorithm for Generating Inverse Printer Map with Reduced Measurements," Proceeding of IEEE International Conference on Acoustics, Speech, and Signal Processing, May 14-19, 2006.

In the third operation 206 illustrated in FIG. 2, the second relationship (e.g., sparse 3D LUT 52) is established between the display input values, which are device-dependent, and the resulting color responses, which are device-independent, for at least one testing display module 30 utilizing the M color patches. To establish this second relationship, M input values 26 (e.g., M RGB input values) are sent to at least one testing display module 30 (e.g., source display module 32, target display module 34, display module 36) and output values 28 (e.g., XYZ values) are measured for the M color patches on the testing display module 30 responsive to the M input values 26. The output values 28 may be measured by at least one sensor 64, such as an optical instrument (e.g., spectrometer, spectroradiometer). In aspects, the sensor(s) 64 provides color measurement data in colorimetric forms, such as in XYZ values. With these measurements, a sparse 3D LUT 52 relating the input values 26 to the corresponding measured output values 28 for the set of M color patches on the testing display module(s) 30 is generated.

The original input values 22 and the M input values 26 may be RGB input values. In aspects, the original input values 22 and the M input values 26 are the same types of input values (e.g., both are RGB input values), whereas in other aspects, the M input values 26 are a subset of the original input values 22.

The sparse 3D LUT 52 may include a lattice of scattered color points. In aspects, the lattice is irregular due to non-linearity between input and output values. In aspects, the dynamic optimization algorithm selects the set of M color patches so that the sparse 3D LUT 52 generated has more data points in areas in which the display color gamut shows more non-linearity and fewer data points in areas in which measured colors are more linear with respect to the input signal. This may be done to avoid display calibration error.

The third relationship defines a device-specific set of color patches (e.g., 4913 color patches) that define a relationship between the input color space (e.g., RGB) and the output color space (e.g., XYZ). This relationship can be used to tune the input display values to produce the desired output color space. In the fourth operation 208 illustrated in FIG. 2, entries in the second relationship (sparse 3D LUT 52) are up-sampled establish a third relationship (forward 3D LUT 54). In aspects, the M color patches selected by the dynamic optimization algorithm is not distributed uniformly in a regular grid. Scattered data interpolation (e.g., triangulation-based interpolation method) can be used to approximate underlying continuous functions of three independent variables that are known just in some scattered points in three-dimensional space. The underlying function f: R3→R3 establishes a mapping between device-dependent color space (e.g., RGB values) and device-independent color space (e.g., XYZ values). The interpolation process used can be changed independently of the triangulation. The linear interpolation method used for up-sampling the sparse 3D LUT 52 may be based on computing the weighted sum of values of the four vertices of the enclosing tetrahedron in which the query point is located.

For example, the non-linear output values 28 and input values 26 in the second relationship (sparse 3D LUT 52) may be up-sampled through a triangulation-based interpolation method to estimate intermediate output values (e.g., XYZ output values) in addition to the output values 28 in the sparse 3D LUT 52. The intermediate output values may be stored as device data 46 on the CRM 44. The intermediate output values and the values in the sparse 3D LUT 52 may be utilized to generate the forward 3D LUT 54. Through an interpolation process M color patches in the sparse 3D LUT 52 are interpolated to estimate the remaining color patches (e.g., to total 4913 for a 17×17×17 LUT) in the forward 3D LUT 54 instead of measuring all N×N×N color patches (e.g., using sensor(s) 64 to measure) on the testing display module(s) 30.

The triangulation-based interpolation method used for up-sampling the sparse LUT 52 may be any suitable interpolation process, including triangular interpolation (in 2D space), tetrahedral interpolation (in 3D space), and the like. An example of a triangular interpolation process includes triangulation of the irregular input lattices (e.g., RGB input lattice points) utilizing a Delaunay triangulation technique (e.g., utilizing a Delaunay triangulation algorithm) to form a plurality of Delaunay triangles, locating Delaunay triangles to which an input color (e.g., RGB input value) belongs (e.g., which encloses the query point), and performing triangular interpolation on the located Delaunay triangles to estimate output values (e.g., XYZ output values) corresponding to the given input values. Delaunay triangulation may be carried out just once and the underlying created triangles are used for all subsequent queries. The interpolation method may be changed independently of the triangulation.

An example of a tetrahedral interpolation process includes tetrahedralization of the irregular input lattices (e.g., RGB input lattice points) utilizing a Delaunay tetrahedralization technique (e.g., utilizing a Delaunay tetrahedralization algorithm) to form a plurality of Delaunay tetrahedrons, locating Delaunay tetrahedrons to which an input color (e.g., RGB input value) belongs (e.g., which encloses the query point), and performing tetrahedral interpolation on the located Delaunay tetrahedrons to estimate output values (e.g., XYZ output values) corresponding to the given input values. Another example of a tetrahedral interpolation process is three-dimensional Delaunay tetrahedralization, which is a tetrahedralization obtained by connecting all the neighboring points in the Voronoi diagram of the given data points. For example, a tetrahedral interpolation process could include tetrahedralization of the irregular input lattices (e.g., RGB input lattices) utilizing a three-dimensional Delaunay tetrahedralization technique to form a plurality of Delaunay tetrahedra, locating Delaunay tetrahedrons to which an input color (e.g., an RGB input color) belongs, and performing tetrahedral interpolation on the located Delaunay tetrahedrons to estimate output values (e.g., XYZ output values) corresponding to the given input values. In aspects, the RGB input color is an RGB triplet, and performing tetrahedral interpolation on the located Delaunay tetrahedrons to estimate XYZ output values corresponding to the given RGB input values includes barycentric interpolation of the XYZ output values of the vertices of the tetrahedron surrounding the RGB triplet. Delaunay tetrahedralization may be carried out just once and the underlying created tetrahedrons are used for all subsequent queries. The interpolation method may be changed independently of the triangulation.

After interpolation, the forward 3D LUT 54 includes a device-specific set of color patches (e.g., 4913 color patches) that gives the relationship between the input color space (e.g., RGB) and the output color space (e.g., XYZ) that can be used to tune the input display values to produce the desired output color space.

In the fifth operation 210, once the forward 3D LUT 54 is constructed for a three-to-three map, its inverse LUT can be computed. Through such a process, the forward 3D LUT 54 is inverted to create a per-unit reverse 3D LUT 56. The forward 3D LUT 54 is inverted (e.g., transformed by inversion) to establish (generate) the fourth relationship (the reverse 3D LUT 56) for use in determining corrected output values 29 (e.g., RGB output values) for driving a target display module 70 to generate color lights within a display module color gamut (e.g., RGB color space). For example, a forward RGB-to-XYZ 3D LUT 54 could be inverted to a reverse XYZ-to-RGB 3D LUT 56. As a result of the backward (reverse) transformation, the native gamut of the target display module 70 maps as closely as possible to the gamut of a target color space. The target color space can be either a standard (e.g., standard RGB (sRGB)) or a custom color space.

In aspects, one or more additional computing devices may be provided, and aspects of these processes may be implemented on such additional computing devices. For example, the first computing device 40 may perform processes related to the first operation 202, the second operation 204, and the third operation 206, and a second computing device (not illustrated) may perform processes related to the fourth operation 208 and the fifth operation 210. The first and second computing devices may be connected and share information. For example, the second computing device may receive information relating to the set of M color patches from the measured 3D LUT 50 to measure on one or more testing display modules 30.

Accuracy Measurement

Figure 3:
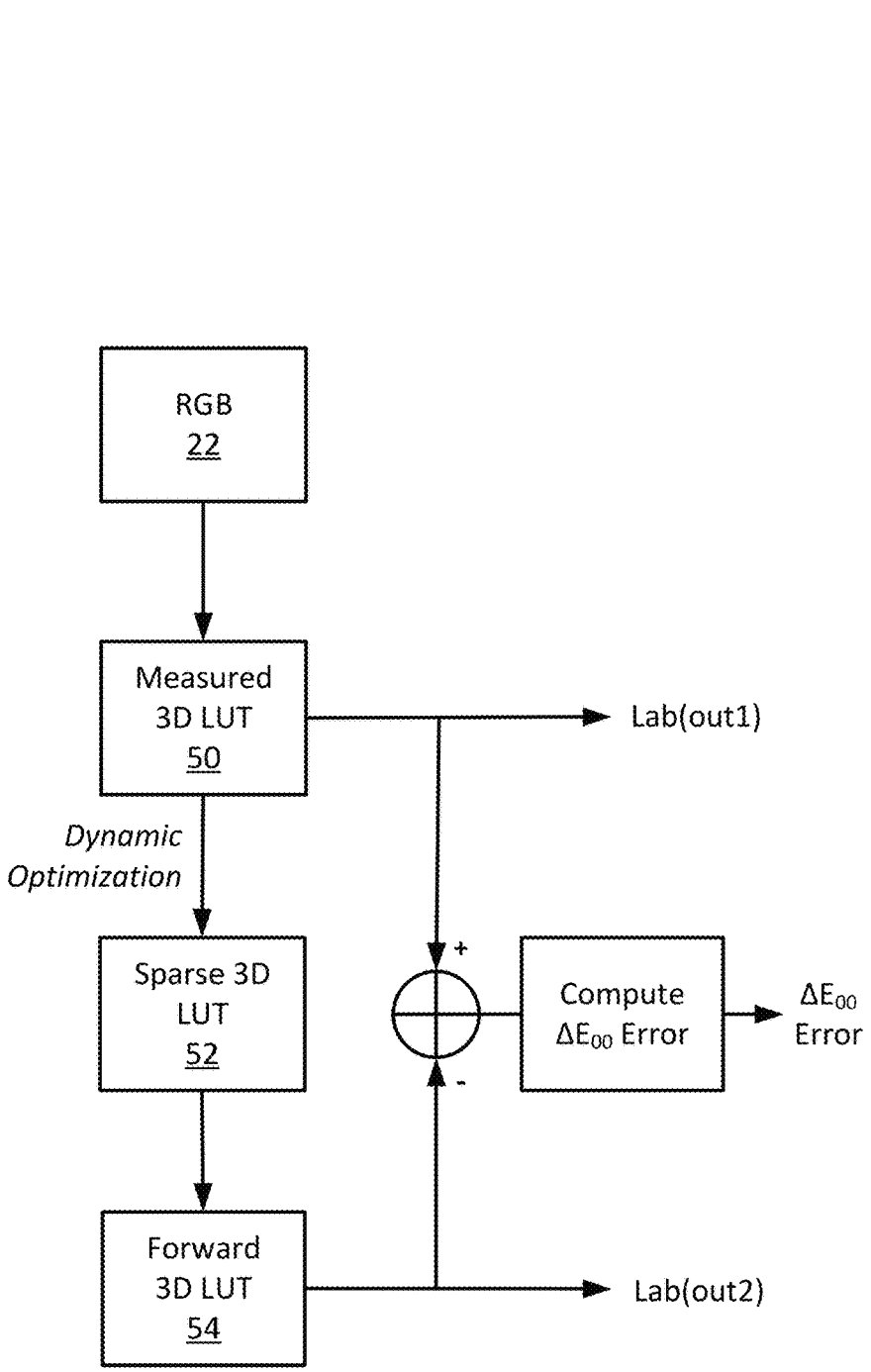
FIG. 3 is a schematic block diagram illustration of a color patch selection method utilized for obtaining a set of M color patches for measurement and generating a forward three-dimensional lookup table.

In aspects, the accuracy of the inversion is measured, for example utilizing the color patch selection method illustrated in FIG. 3. FIG. 3 is a schematic block diagram illustration of a color patch selection method 300 utilized for obtaining a set of M color patches for measurement and generating a forward 3D LUT 54 (e.g., forward RGB-to-XYZ 3D LUT 54). Uncalibrated display input values 22 (e.g., RGB input values) are provided as input (sent) to the source display module 32. The resulting color responses (display characteristics) are measured, for example, by a sensor(s), and display characteristic measurements (output values 24) are provided in a colorimetric form (e.g., XYZ values). The computing device 40 can then form a table of N×N×N lattice points and generate a measured 3D LUT 50 (e.g., measured RGB-to-XYZ 3D LUT 50) relating the uncalibrated display input values 22 to the resulting (measured) color responses (output values 24).

Through dynamic optimization (e.g., utilization of a dynamic optimization algorithm), the N×N×N lattice points are down-sampled to M×M×M lattice points (sparse 3D LUT 52) by selecting a set of M color patches for measurement such that, when the down-sampled sparse 3D LUT 52 is up-sampled to the original size (the forward 3D LUT 54), the computed $\Delta E_{00}$ error between the original colorimetric values (e.g., XYZ (Lab(out1)) and the up-sampled colorimetric values (e.g., XYZ (Lab(out2)) is minimized.

Calibration Testing

A calibration testing process could be utilized for testing the accuracy of the process of color calibrating display modules. In aspects, the process of color calibrating display modules is evaluated based on the color difference between the color that is created by feeding the calculated RGB values to the display module and the target XYZ values. In aspects, a display module is driven by a display device and the method of color calibrating a display module includes creating a calibration profile utilizing a reverse 3D LUT 56 (e.g., reverse XYZ-to-RGB 3D LUT 56) for the testing display module(s) 30 and storing the calibration profile on at least one of the target display device 12 or a display module 34, for example in on at least one of the target display device or the target display module 70, for example, in memory (e.g., in memory 35 on at least one of the target display device 12 or the target display module 34). In aspects, a calibration profile utilizing the reverse XYZ-to-RGB 3D LUT 56 for the target display module 70 can be updated.

The method of color calibrating display modules may include measuring XYZ output values across the color gamut of the target display module 70 responsive to the RGB input values. The measured XYZ output values for the set of test RGB color patches on the testing display module (s) 30 may be responsive to the input test RGB values by sensor(s) 64. The calibration testing process may include using a delta E equation to determine color differences between the measured XYZ values on the testing display module(s) 30 responsive to test RGB values and calculated XYZ values for corresponding test RGB values using standard pre-established matrices.

Methods

An example method of calibrating a display module (e.g., an OLED display module) includes establishing a relationship (measured 3D LUT 50) between the uncalibrated display RGB input values 22 and the resulting color (XYZ) responses 24 for a source display module 32 having a color gamut, utilizing a dynamic optimization algorithm to generate a set of M color patches from the measured 3D LUT 50, sending M color patches (e.g., M RGB input values 26) to a testing display module 30, measuring XYZ output values 28 for the set of M color patches on the testing display module(s) 30 responsive to the M RGB input values 26, generating a mapping (sparse 3D LUT 52) relating the input values 26 to corresponding measured output values 28, up-sampling (e.g., utilizing an interpolation process) the entries in the sparse 3D LUT 52 to generate a forward RGB-to-XYZ 3D LUT, inverting the RGB-to-XYZ 3D LUT to generate a XYZ-to-RGB 3D LUT, and utilizing the XYZ-to-RGB 3D LUT to determine corrected RGB output values 29 for driving the target display module 70 to generate color lights in an RGB color space.

Another example method of calibrating a display module (e.g., an OLED display module) includes operations of (1) taking a source display module with a given color gamut; (2) feeding the source display module a set of color patches (e.g., K number (all possible N×N×N) of RGB color patches), measuring XYZ values across the color gamut of the source display module, and generating a measured three-dimensional lookup table relating the original RGB color patches (input values) to corresponding measured XYZ output values (e.g., measured lookup table 50); (3) using a dynamic optimization algorithm to choose M number of color patches out of the K number (all possible N×N×N) of RGB color patches; and (4) performing interpolation to construct a full-size three-dimensional lookup table (N×N×N) (e.g., forward lookup table 54).

Figure 4:
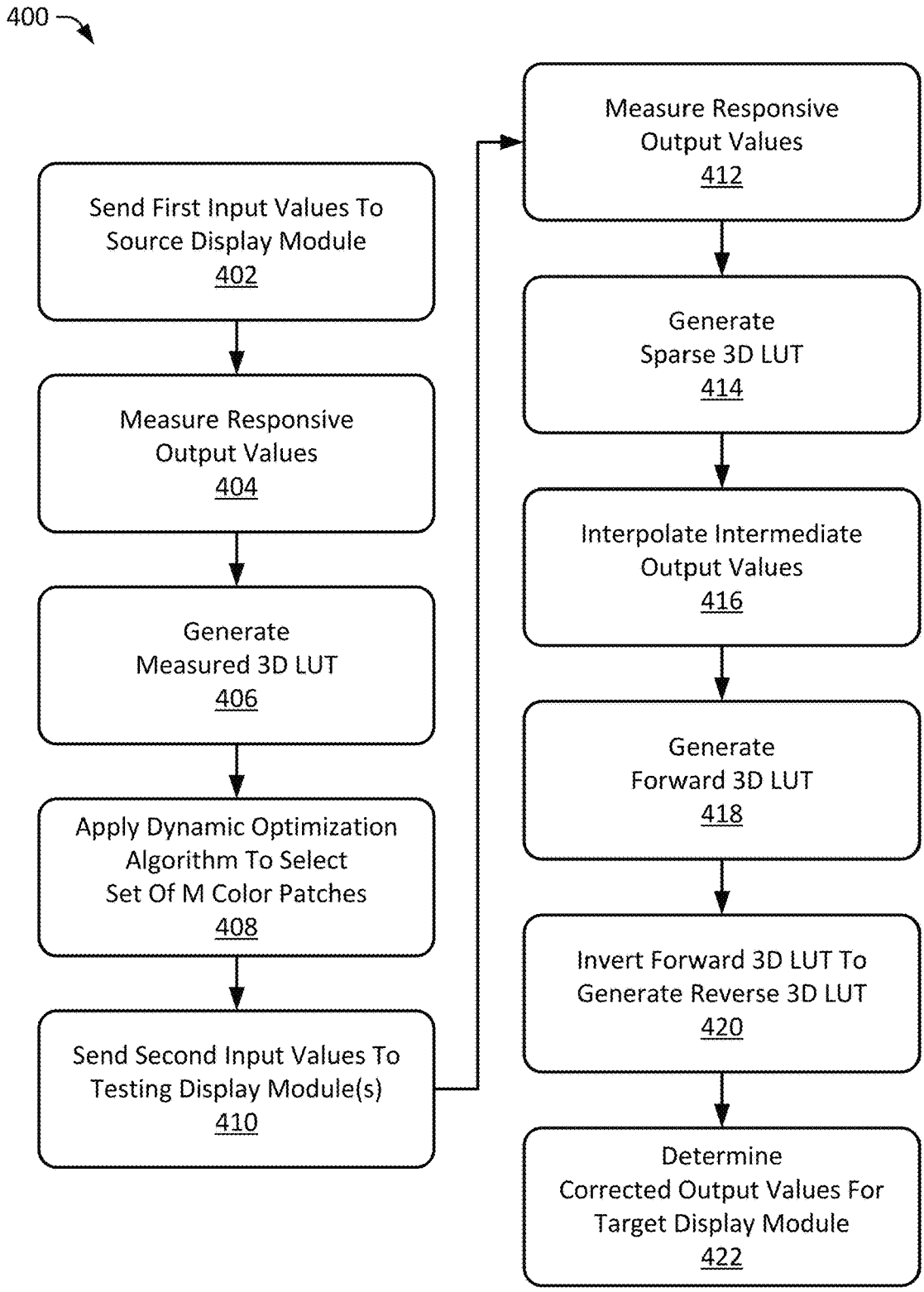
FIG. 4 illustrates a method of performing color calibration of display modules using a reduced number of display characteristic measurements.

FIG. 4 illustrates an example method 400 of performing color calibration of display modules using a reduced number of display characteristic measurements. At 402, original input values (e.g., RGB input values) are sent to a source display module having a color gamut. At 404, output values (e.g., XYZ output values) across the color gamut of the source display module responsive to the original input values are measured. At 406, a LUT module on the computing device generates a three-dimensional lookup table (measured 3D LUT) relating the original input values to the corresponding measured output values (e.g., a measured RGB-to-XYZ three-dimensional lookup table relating RGB input values to corresponding measured XYZ output values). The measured 3D LUT includes a set of K number of color patches (e.g., K RGB color patches).

At 408, a dynamic optimization algorithm is applied to select a set of M color patches from the K color patches included in the measured 3D LUT. At 410, M input values (e.g., M RGB input values) are sent to a testing display module(s) having at least one second color gamut. At 412, output values (e.g., XYZ output values) for the set of M color patches are measured on the testing display module(s) responsive to the M input values. At 414, a sparse 3D LUT relating the M input values to corresponding output values is generated. At 416, the measured output values in the sparse 3D LUT are utilized to interpolate intermediate output values (e.g., XYX output values).

At 418, a forward 3D LUT (e.g., an RGB-to-XYZ 3D LUT) is generated utilizing the intermediate output values and the values in the sparse 3D LUT. At 420, the forward 3D LUT is transformed to generate a reverse 3D LUT (e.g., an XYZ-to-RGB 3D LUT) by performing an inversion process on the forward 3D LUT. At 422, the reverse 3D LUT is utilized to determine corrected output values (e.g., RGB output values) for driving the target display module to generate color lights in a color space (e.g., RGB color space). In aspects, the source display module, testing display module(s), and the target display module are organic light-emitting diode display modules.

In aspects, a method of performing color calibration of display modules using a reduced number of display characteristic measurements is implemented by a computing device. At a first operation, the computing device sends original input values (e.g., RGB input values) to a source display module having a color gamut. At a second operation, the computing device measures output values (e.g., XYZ output values) across the color gamut of the source display module responsive to the original input values. In aspects, the computing device utilizes a sensor to measure the output values across the color gamut of the source display module. At a third operation, a lookup table (LUT) module of the computing device generates a measured three-dimensional (3D) LUT relating original input values to the corresponding measured output values. In aspects, the measured 3D LUT is a measured RGB-to-XYZ 3D LUT relating RGB input values to the corresponding measured XYZ output values. The measured 3D LUT includes K number of color patches (e.g., K RGB color patches).

At a fourth operation, the computing device applies a dynamic optimization algorithm to select a set of M color patches from the K color patches included in the measured 3D LUT. At a fifth operation, the computing device sends M input values (e.g., M RGB input values) to testing display module(s) having at least one second color gamut. At a sixth operation, output values (e.g., XYZ output values) for the set of M color patches are measured by the computing device on the testing display module(s) responsive to the M input values. In aspects, the computing device utilizes a sensor to measure the output values for the set of M color patches.

At a seventh operation, a sparse 3D LUT relating the M input values to corresponding output values is generated. At an eighth operation, entries (e.g., the measured output values) in the sparse 3D LUT are interpolated to generate intermediate output values. At a ninth operation, a forward 3D LUT (e.g., an RGB-to-XYZ 3D LUT) relating the M input values to corresponding output values for the set of K color patches on the testing display module(s) is generated (e.g., utilizing the intermediate output values and the values in the sparse 3D LUT). At a tenth operation, the LUT module on the computing device generates a forward 3D LUT (e.g., an RGB-to-XYZ 3D LUT) relating the original input values to corresponding output values for the set of K color patches on the testing display module(s). At an eleventh operation, the LUT module on the computing device transforms the forward 3D LUT to generate a reverse 3D LUT (e.g., an XYZ-to-RGB 3D LUT) by performing an inversion process on the forward 3D LUT. At a twelfth operation, the computing device utilizes the reverse 3D LUT to determine corrected output values (e.g., RGB output values) for driving the target display module to generate color lights in a color space (e.g., RGB color space). In aspects, the source display module, testing display module(s), and the target display module are organic light-emitting diode display modules.

EXAMPLES

In the following section, some examples are described:

Example 1: A method (400) of performing color calibration of organic light-emitting diode display modules using a reduced number of display characteristic measurements, the method comprising: sending (402) original RGB input values (22) to an organic light-emitting diode source display module (32) having a first color gamut; measuring (404) XYZ output values (24) across the first color gamut; generating (406) a measured three-dimensional lookup table (50) relating the original RGB input values (22) to corresponding measured XYZ output values (24); using (408) dynamic optimization to select a set of M number of RGB input values (26) from the original RGB input values (22); sending (410) the M RGB input values (26) to an organic light-emitting diode testing display module (30) having at least one second color gamut; measuring (412) XYZ output values (28) across the second color gamut for the M RGB input values (26); generating (414) a sparse three-dimensional lookup table (52) relating the M RGB input values (26) to corresponding measured XYZ output values (28); up-sampling the sparse three-dimensional lookup table (52) to generate (418) a forward three-dimensional lookup table (54) relating RGB input values to corresponding XYZ output values; transforming (420) the forward three-dimensional lookup table (54) to generate a reverse three-dimensional lookup table (56) by performing an inversion process on the forward three-dimensional lookup table (54); and utilizing (420) the reverse three-dimensional lookup table (56) to determine corrected RGB output values (29) for driving an organic light-emitting diode target display module (70).

Example 2: The method of example 1, wherein up-sampling the sparse three-dimensional lookup table to generate a forward three-dimensional lookup table relating RGB input values to corresponding XYZ output values comprises generating intermediate XYZ output values utilizing the measured XYZ output values in the sparse three-dimensional lookup table.

Example 3: The method of example 2, wherein generating intermediate XYZ output values utilizing the measured XYZ output values in the sparse three-dimensional lookup table comprises utilizing a triangulation-based interpolation method to estimate the intermediate XYZ output values.

Example 4: The method of example 3, wherein the triangulation-based interpolation method utilized to estimate the intermediate XYZ output values is a tetrahedral interpolation process further comprises forming a plurality of Delaunay tetrahedron by tetrahedralization of irregular input lattice points in the sparse three-dimensional lookup table utilizing a three-dimensional Delaunay tetrahedralization technique; selecting an RGB input color; locating Delaunay tetrahedrons to which the RGB input color belongs; and performing tetrahedral interpolation on the located Delaunay tetrahedrons to estimate an intermediate XYZ output value corresponding to the selected RGB input color.

Example 5: The method of example 4, wherein the RGB input color comprises an RGB triplet and wherein performing tetrahedral interpolation on the located Delaunay tetrahedrons to estimate an intermediate XYZ output value corresponding to the selected RGB input color further comprises performing barycentric interpolation of XYZ values of vertices of a Delaunay tetrahedron surrounding the RGB triplet.

Example 6: The method of example 4, wherein performing tetrahedral interpolation on the located Delaunay tetrahedrons to estimate an intermediate XYZ output value corresponding to the selected RGB input color further comprises performing linear interpolation in the form of distance-weighted average among neighboring vertices on the located Delaunay tetrahedrons.

Example 7: The method of example 3, wherein the triangulation-based interpolation method utilized to estimate the intermediate XYZ output values is a triangular interpolation process further comprises: forming a plurality of Delaunay triangles by triangulation of irregular input lattice points in the sparse three-dimensional lookup table utilizing a three-dimensional Delaunay triangulation technique; selecting an RGB input color; locating Delaunay triangles to which the RGB input color belongs; and performing triangular interpolation on the located Delaunay triangles to estimate an intermediate XYZ output value corresponding to the selected RGB input color.

Example 8: The method of any preceding example, wherein the target display module is driven by a target display device, wherein the method further comprises utilizing the reverse three-dimensional lookup table to create a calibration profile for the target display module and storing the calibration profile on at least one of the target display device or the target display module.

Example 9: The method of example 8, further comprising updating a calibration profile stored on at least one of the target display device or the target display module.

Example 10: The method of any preceding example, wherein measuring XYZ output values across the first color gamut is performed by a sensor.

Example 11: The method of any preceding example, wherein measuring XYZ output values across the second color gamut is performed by a sensor.

Example 12: The method of any preceding example, wherein using dynamic optimization to select a set of M number of RGB input values from the original RGB input values further comprises applying a dynamic optimization algorithm.

Example 13: The method of example 12, wherein the dynamic optimization algorithm selects the set of M number of RGB input values to minimize the total error between the measured CIELAB output values and the estimated CIELAB output values for the original RGB input values.

Example 14: The method of example 1, further comprising utilizing the reverse three-dimensional lookup table to determine corrected RGB output values for driving at least one of the organic light-emitting diode testing display module or an organic light-emitting diode display target display module.

Example 15: A computing device comprising a processor; and a computer-readable storage medium having stored thereon instructions that, responsive to execution by the processor, cause the processor to execute the method of any of examples 1 to 14.

CONCLUSION

Although techniques and apparatuses for performing color calibration of display modules using a reduced number of display characteristic measurements have been described in language specific to features and/or methods, it is to be understood that the subject of the appended claims is not necessarily limited to the specific features or methods described. Rather, the specific features and methods are disclosed as example implementations of techniques and apparatuses for performing color calibration of display modules using a reduced number of display characteristic measurements.

What is claimed is:

1. A method of performing color calibration of display modules comprising:

sending original red, green, blue color space (RGB) input values to a first display module having a first color gamut;

measuring XYZ color space (XYZ) output values across the first color gamut;

generating a measured three-dimensional lookup table relating the original RGB input values to corresponding measured XYZ output values;

using dynamic optimization to select a set of M number of RGB input values from the original RGB input values;

sending the M RGB input values to a second display module having a second color gamut;

measuring XYZ output values across the second color gamut for the M RGB input values;

generating a sparse three-dimensional lookup table relating the M RGB input values to corresponding measured XYZ output values;

up-sampling the sparse three-dimensional lookup table to generate a forward three-dimensional lookup table relating RGB input values to corresponding XYZ output values;

transforming the forward three-dimensional lookup table to generate a reverse three-dimensional lookup table by performing an inversion process on the forward three-dimensional lookup table; and utilizing the reverse three-dimensional lookup table to determine corrected RGB output values for driving a third display module.

2. The method of claim 1, the up-sampling the sparse three-dimensional lookup table to generate a forward three-dimensional lookup table relating RGB input values to corresponding XYZ output values comprising:

generating intermediate XYZ output values utilizing the measured XYZ output values in the sparse three-dimensional lookup table.

3. The method of claim 2, the generating intermediate XYZ output values utilizing the measured XYZ output values in the sparse three-dimensional lookup table comprising:

utilizing a triangulation-based interpolation method to estimate the intermediate XYZ output values.

4. The method of claim 3, wherein the triangulation-based interpolation method utilized to estimate the intermediate XYZ output values is a tetrahedral interpolation process further comprises:

forming a plurality of Delaunay tetrahedron by tetrahedralization of irregular input lattice points in the sparse three-dimensional lookup table utilizing a three-dimensional Delaunay tetrahedralization technique;

selecting an RGB input color;

locating Delaunay tetrahedrons to which the RGB input color belongs; and performing tetrahedral interpolation on the located Delaunay tetrahedrons to estimate an intermediate XYZ output value corresponding to the selected RGB input color.

5. The method of claim 4, wherein the RGB input color comprises an RGB triplet; and wherein performing tetrahedral interpolation on the located Delaunay tetrahedrons to estimate an intermediate XYZ output value corresponding to the selected RGB input color further comprises:

performing barycentric interpolation of XYZ values of vertices of a Delaunay tetrahedron surrounding the RGB triplet.

6. The method of claim 4, the performing tetrahedral interpolation on the located Delaunay tetrahedrons to estimate an intermediate XYZ output value corresponding to the selected RGB input color further comprising:

performing linear interpolation in the form of a distance-weighted average among neighboring vertices on the located Delaunay tetrahedrons.

7. The method of claim 3, wherein the triangulation-based interpolation method utilized to estimate the intermediate XYZ output values is a triangular interpolation process further comprises:

forming a plurality of Delaunay triangles by triangulation of irregular input lattice points in the sparse three-dimensional lookup table utilizing a three-dimensional Delaunay triangulation technique;

selecting an RGB input color;

locating Delaunay triangles to which the RGB input color belongs; and performing triangular interpolation on the located Delaunay triangles to estimate an intermediate XYZ output value corresponding to the selected RGB input color.

8. The method of claim 1, further comprising:

utilizing the reverse three-dimensional lookup table to create a calibration profile for the third display module; and storing the calibration profile on at least one of:

a target display device driving the third display module, or the third display module.

9. The method of claim 1, further comprising:

utilizing the reverse three-dimensional lookup table to update a calibration profile stored on at least one of:

a target display device driving the third display module, or the third display module.

10. The method of claim 1, wherein using dynamic optimization to select a set of M number of RGB input values from the original RGB input values comprises:

selecting the set of M number of RGB input values to minimize a total error between measured CIELAB output values and estimated CIELAB output values for the original RGB input values.

11. The method of claim 1, wherein two or more of the first display module, the second display module, or the third display module are a single display module.

12. A method of testing color calibration of display modules, the method comprising:

sending original red, green, blue color space (RGB) input values to a first display module having a first color gamut;

measuring XYZ color space (XYZ) output values across the first color gamut;

generating a measured three-dimensional lookup table relating the original RGB input values to corresponding measured XYZ output values;

using dynamic optimization to select a set of M number of RGB input values from the original RGB input values;

sending the M RGB input values to a second display module having a second color gamut;

measuring XYZ output values across the second color gamut for the M RGB input values;

generating a sparse three-dimensional lookup table relating the M RGB input values to corresponding measured XYZ output values;

up-sampling the sparse three-dimensional lookup table to generate a forward three-dimensional lookup table relating RGB input values to corresponding XYZ output values;

transforming the forward three-dimensional lookup table to generate a reverse three-dimensional lookup table by performing an inversion process on the forward three-dimensional lookup table;

selecting test RGB input values for driving a third display module;

driving the third display module utilizing the test RGB input values;

measuring XYZ output values across a color gamut of the third display module responsive to the test RGB input values;

utilizing the reverse three-dimensional lookup table to calculate XYZ output values for the test RGB input values; and determining a color difference between the measured XYZ output values across the color gamut of the third display module responsive to the test RGB input values and the calculated XYZ output values for corresponding RGB input values.

13. The method of claim 12, wherein up-sampling the sparse three-dimensional lookup table to generate a forward three-dimensional lookup table relating RGB input values to corresponding XYZ output values comprises:

generating intermediate XYZ output values utilizing the measured XYZ output values in the sparse three-dimensional lookup table.

14. The method of claim 12, wherein two or more of the first display module, the second display module, or the third display module are a single display module.

15. The method of claim 12, further comprising:

utilizing the reverse three-dimensional lookup table to create a calibration profile for the third display module; and storing the calibration profile on at least one of:

a target display device driving the third display module, or the third display module.

16. A computing device comprising:

a processor; and a computer-readable storage medium having stored thereon instructions that, responsive to execution by the processor, cause the processor to perform operations comprising:

send original red, green, blue color space (RGB) input values to a first display module having a first color gamut;

measure XYZ color space (XYZ) output values across the first color gamut;

generate a measured three-dimensional lookup table relating the original RGB input values to corresponding measured XYZ output values;

use dynamic optimization to select a set of M number of RGB input values from the original RGB input values;

send the M RGB input values to a second display module having a second color gamut;

measure XYZ output values across the second color gamut for the M RGB input values;

generate a sparse three-dimensional lookup table relating the M RGB input values to corresponding measured XYZ output values;

up-sample the sparse three-dimensional lookup table to generate a forward three-dimensional lookup table relating RGB input values to corresponding XYZ output values;

transform the forward three-dimensional lookup table to generate a reverse three-dimensional lookup table by performing an inversion process on the forward three-dimensional lookup table; and utilize the reverse three-dimensional lookup table to determine corrected RGB output values for driving a third display module.

17. The computing device of claim 16, wherein operation of up-sample the sparse three-dimensional lookup table to generate a forward three-dimensional lookup table relating RGB input values to corresponding XYZ output values further comprises the processor performing an operation to:

generate intermediate XYZ output values utilizing the measured XYZ output values in the sparse three-dimensional lookup table.

18. The computing device of claim 16, wherein the instructions further cause the processor to perform operations comprising:

drive, by a target display device, the third display module;

utilize the reverse three-dimensional lookup table to create a calibration profile for the third display module; and store the calibration profile on at least one of:

a target display device driving the third display module, or the third display module.

19. The computing device of claim 16, further comprising at least one of:

wherein the operation of measure the XYZ output values across the first color gamut is performed utilizing a sensor; or wherein the operation of measure the XYZ output values across the second color gamut for the M RGB input values is performed utilizing a sensor.

20. The computing device of claim 16, wherein two or more of the first display module, the second display module, or the third display module are a single display module.

* * * * *